United States Patent [19]

Mann

[11] Patent Number: 4,881,913

[45] Date of Patent: Nov. 21, 1989

[54] EXTENDED LIFE SPARK PLUG/IGNITER

[75] Inventor: Gamdur S. Mann, Grand Blanc, Mich.

[73] Assignee: General Motors Corporation, Detroit, Mich.

[21] Appl. No.: 346,968

[22] Filed: May 3, 1989

Related U.S. Application Data

[62] Division of Ser. No. 207,586, Jun. 16, 1988.

[51] Int. Cl.[4] ..... H01I 13/20; H01I 13/39

[52] U.S. Cl. ..... 445/7; 148/285; 148/287; 148/16; 313/130

[58] Field of Search ..... 445/7; 148/16, 285, 148/286, 287; 313/130

[56] References Cited

U.S. PATENT DOCUMENTS

| | | | |
|---|---|---|---|
| 2,733,369 | 1/1956 | Smits | 445/7 |
| 2,900,547 | 8/1956 | Engel | 313/130 |
| 3,920,486 | 11/1975 | Howell et al. | 148/274 |
| 3,984,717 | 10/1976 | Romanowski et al. | 313/141 |
| 4,427,915 | 1/1984 | Nishio et al. | 313/141 |
| 4,465,952 | 8/1984 | Sato et al. | 313/136 |
| 4,488,081 | 12/1984 | Kondo et al. | 313/141 X |
| 4,540,910 | 9/1986 | Kondo et al. | 313/141 |
| 4,581,558 | 4/1986 | Takamura et al. | 313/141 |
| 4,659,960 | 4/1987 | Toya et al. | 313/141 |
| 4,661,169 | 4/1987 | Aggen et al. | 148/285 |
| 4,670,684 | 6/1987 | Kagawa et al. | 313/141 |
| 4,692,657 | 9/1987 | Grunwald et al. | 313/130 |
| 4,742,265 | 5/1988 | Giachino et al. | 313/141 |

FOREIGN PATENT DOCUMENTS

| | | | |
|---|---|---|---|
| 30333 | 3/1979 | Japan | 313/630 |

*Primary Examiner*—Kenneth J. Ramsey
*Attorney, Agent, or Firm*—R. W. Tung

[57] ABSTRACT

A spark plug has a center electrode and a side electrode made of an iron-base, heat resistant (iron, chromium, aluminum, rare earth) alloy. Each electrode has a precious metal insert of a composition that thermally matches the base alloy of the electrodes. The electrodes are made by a method which coats the electrodes with a protective coating to reduce operational oxidation and lead/oil deposit degradation of the interface between such iron based heat resistant alloys and an insert button in the center and side electrodes so as to extend the spark plug's life.

8 Claims, 2 Drawing Sheets

EXTENDED LIFE SPARK PLUG/IGNITER

This is a division of application Ser. No. 207,586 filed on June 16, 1988.

BACKGROUND OF THE INVENTION

This invention relates to spark plugs and more particularly to spark plugs which includes precious metal electrode inserts and a method of making electrodes therefor to improve durability.

Spark plugs in internal combustion engines, igniters in gas turbines and jet engines are used for igniting combustible mixtures of gases and vapors. The electrodes for these devices are generally made of nickel base alloys, nickel alloy/nickel clad copper core, precious metals (platinum, Palladium, Iridium, etc.), or a combination of these materials. For economic reasons, the demand for longer life devices has been increasing, and the industry has responded with various proposals for extended life spark plugs and igniters. In the past, such devices were made by using precious metal electrodes. Since these metals are expensive, a compromise between service life and cost was reached by use of combination nickel base alloy electrodes and precious metal inserts.

Electrode materials experience quite severe environmental conditions, such as thermal cycling, pressure cycling, vibrations, electrical discharge cycling, exposure to deposits, and exposure to low and high temperature reactive gases. In designing electrodes, as well as electrode materials, many parameters and material properties must be considered simultaneously. Examples of such parameters can include:

(i) oxidation resistance (ii) carburization resistance (iii) sulfidation resistance (iv) resistance to lead and other oil deposits (v) spark erosion resistance (vi) thermal shock resistance (vii) high temperature and pressure stability of both the base material and its protective oxides (viii) softening and melting points (ix) electrical resistivity (x) thermal diffusivity Attempts to provide more durable spark plug and igniter construction have included several suggestions which combine use of a nickel base alloy and a precious metal insert constructions.

Examples of patents which show spark plugs and igniters with such precious metal inserts includes U.S. Pat. Nos. 3,984,717; 4,427,915; 4,465,952; 4,488,081; 4,540,910; and U.K. Pat. No. 2,005,649A. Other patents which disclose use of a nickel base heat resistant composition in the electrodes of such spark plugs and igniters and which provide thermal expansion compensation are set forth in U.S. Pat. Nos. 4,581,558; 4,659,960 and 4,670,684.

While such spark plugs are acceptable compromises, it has been found that nickel base alloys are susceptible to sulfur attack. Lead will attack along the grain boundaries and reduce electrode life.

Precious metal electrodes, while providing excellent overall properties, are far superior in spark erosion resistance as compared to nickel base alloys. Since precious metals are very expensive, the tendency is to use the minimum amount required to give an acceptable performance. As a result, small pieces of precious metal or inserts have been used at the sparking areas. Generally, these "buttons" are resistance welded to nickel base alloys.

Since the button material often differs in composition from the electrode material, differential expansion can cause cracks which can result in separation of the buttons from the electrode. Attempts have also been made (U.S. Pat. No. 4,540,910) to match thermal expansion of precious metal inserts to the base metal by intermediate layers of another material. Since these electrodes provide more useful life, they are usually referred to as "Extended Life Plugs".

Even though such extended life plugs provide improved durability compared to the standard plugs (using nickel base electrodes only), failure problems still persist. The failure mode of these plugs involves:

(a) Cracking and separation (e.g., falling) of precious metal insert from the base electrode (usually made of nickel base alloys).

(b) Oxidation of the precious metal - nickel base interface.

(c) Attack of the interface area by lead and other oil deposits.

(d) Sulfur attack of the nickel base electrode itself.

The failure mode (a) results from thermal expansion mismatch between the material of the nickel base electrode and the material of the precious metal button. Precious metal grain growth in the insert can be produced by high temperature cycling during spark plug operation. Such grain growth also contributes to the cracking problem. Finer grain material is generally more resistant to such crack induced failure (platinum electrodes normally contain very fine zirconia which pins the grain boundaries and thereby slows down the grain growth). Oxidation of the insert/electrode base material interface area (between precious metal button and nickel base electrode) can produce brittle oxide materials which further contribute to the crack failure mode.

Lead and oxide penetration at the interface area can weaken the insert to electrode bond. Eventually such penetration can cause the precious metal button to separate from the base alloy material of the electrode. High sulfur fuel use can lead to severe attack of nickel base electrode at its grain boundaries. Low melting sulfur-nickel liquid can form at operational temperatures of the electrodes. Such liquidous material form can wet such grain boundaries. Such wetting is analagous to loose mortar and bricks and can cause a sudden separation of the insert electrode (just like bricks can be separated when loose mortar fails).

SUMMARY OF THE INVENTION

It is an object of this invention to reduce electrode-/insert interface degradation in extended life spark plugs by use of a heat resistant electrode alloy which has a protective oxide coat which also has a thermal expansion compatible to the thermal expansion of precious metal inserts supported on the electrode.

Another object of the present invention is to provide an extended life spark plug wherein the center and side electrodes are made from an iron base heat resistant alloy which has been selectively or fully pretreated to have a protective oxide layer and wherein the center electrodes has a precious metal insert ("button") bonded at an insert interface to the tip of the center electrode and wherein the side electrode has a pocket formed through its protective oxide layer to receive a precious metal insert bonded by an insert interface layer.

A feature of the present invention is to provide electrode configurations of the type set forth in either of the preceding objects wherein the inserts are zirconia ($ZrO_2$) stabilized platinum inserts and the electrodes are made from Fe—15Cr—4Al thermally matched to the inserts over the entire temperature range.

Still another feature is to provide a preferred base electrode material as Fe—15Cr—4Al—RE (wherein RE=Rare Earth, e.g., Y, Ce, La, , Nd, Pr, etc. from 0 to 1 wt. %) alloy.

A further object of my invention is to provide an improved process for forming an extended life spark plug including the steps of forming center and side electrodes of an oxidizable base metal which is thermally compatible to precious metal inserts and selectively heating the electrodes to provide a thick protective oxide coating thereon while providing oxide free regions for connection of electrical discharge path, precious metal inserts.

These and other objects, features and advantages of my invention will become more apparent from the following description when considered in conjunction with the accompanying drawings wherein:

DESCRIPTION OF THE PREFERRED EMBODIMENTS

Figure 1:
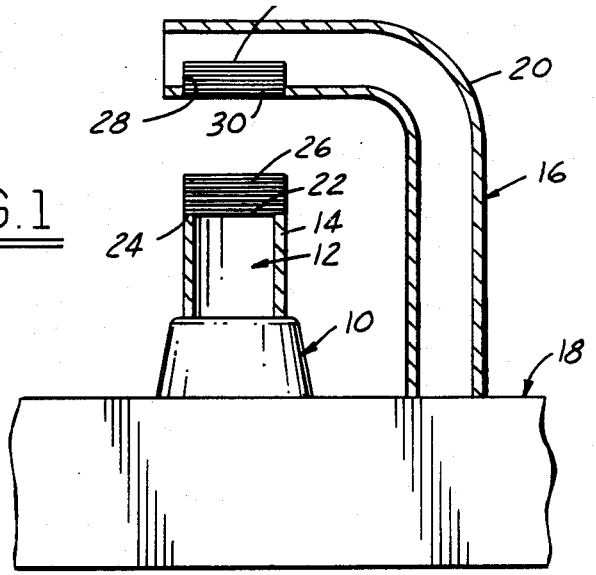
FIG. 1 is a schematic view of a spark plug with the center and side electrodes thereof partially sectioned to show my invention.

Referring now to FIG. 1, a schematic view of a spark plug is shown in accordance with my invention. The spark plug includes a ceramic insulator 10 made of a suitable high temperature resistant material, e.g., $Al_2O_3$. A central electrode 12 is made of an iron based heat resistant alloy pretreated to have a protective oxide coating or layer 14. A ground or side electrode 16 extends from the main metal body 18 formed coaxially of the insulator 10. The ground electrode 16 is also made of an iron based heat resistant alloy having a protective oxide coating or layer 20.

The tip surface 22 of the central electrode is uncoated and it is bonded by an interface region 24 to a first precious metal insert 26.

The ground electrode 16 has an uncoated cavity surface 28 formed therein. A second precious metal insert 30 is bonded to the uncoated cavity surface 28 by an interface region 32 formed between insert 30 and the pocket surface 28. The second precious metal insert 30 is located in facing relationship to the first precious metal insert 26 to form an electrical discharge path between surface 28 and the tip surface 22. The inserts 26, 30 are spaced in accordance with the power source polarity and the operating modes of the associated engine.

A typical automotive engine application has spark plug electrodes operating in a temperature range of 400° C.-900° C. Operating temperatures for jet engines and applications can be higher.

Such temperature ranges can produce substantial thermal expansion in both the base electrode material and the insert material from a cooled ambient state to maximum operating temperatures.

In accordance with my invention, the base electrode material is preferably selected from an iron based alloy and the insert is selected from a precious metal so as to prevent excessive differential thermal expansion therebetween.

Figure 2:
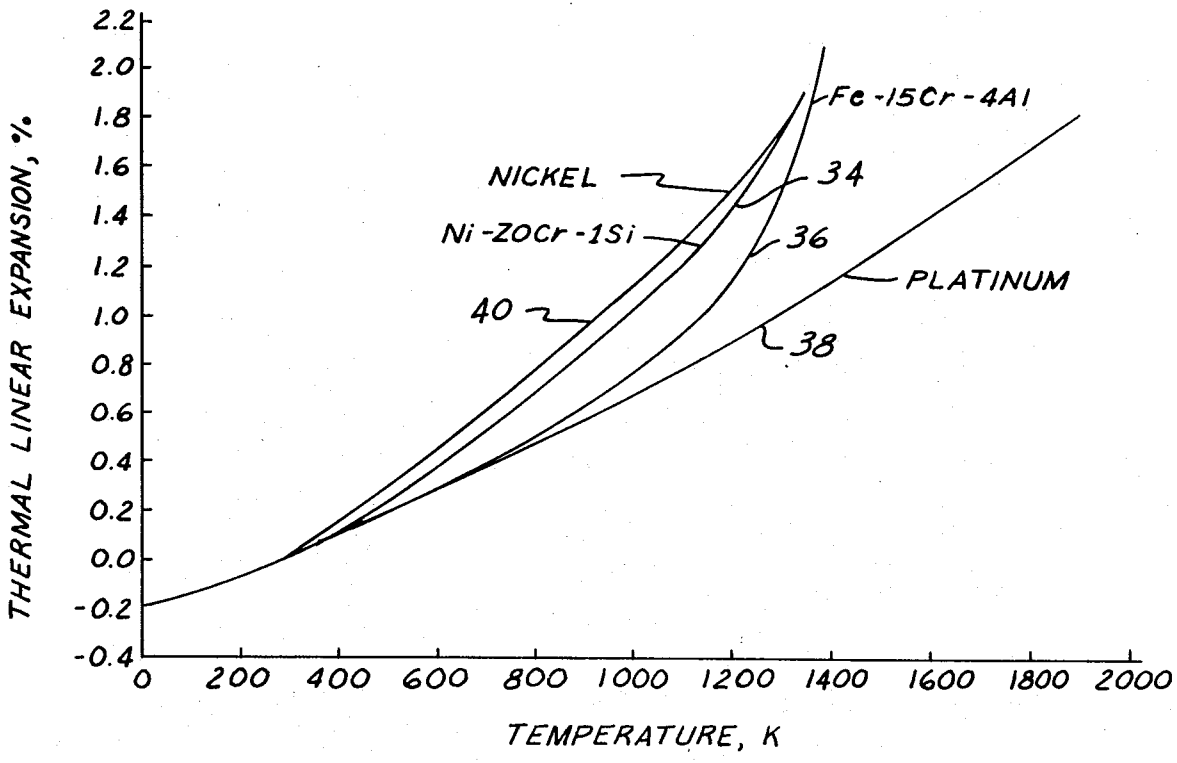
FIG. 2 is a chart showing the thermal expansion characteristics of the base electrode material and precious metal insert material of the present invention.

FIG. 2 shows linear thermal expansion data for several alloys. Curve 40 shows the thermal expansion properties for pure nickel; curve 34 shows the thermal expansion properties for a nickel chromium alloy for practicing the method of the present invention; curve 36 shows the thermal expansion properties for the iron-based alloy of the present invention and curve 38 shows the thermal expansion properties for the precious metal insert of my invention.

First Embodiment

A preferred embodiment comprises the following:

Zirconia ($ZrO_2$) stabilized platinum or palladium material is used for inserts 26, 30. The iron based alloy is Fe—15C—4Al—RE. Re is a rare earth selected from the group (Y, Ce, La, Nd, Pr, etc.) and is approximately in the range of 0 to 1% of the weight of the base metal alloy.

Such small addition of rare earth to the base alloy material improves its oxidation characteristics including oxide adherence and uniformity of oxide. It also reduces cracking in the protective layers 14, 20. The end result is to improve the cyclical oxidation of the base alloy for reasons to be discussed.

Another feature of the invention is that iron based alloys of the aforesaid type are generally more resistant to sulfur and lead attack. Such alloys are also tolerant to phosphorus accumulation. It is known that an Fe—S eutectic temperature is at about 988° C. as compared to 635° C. for Ni—S eutectic. This can cause a sulfur rich liquid phase to form in known nickel base electrodes at lower operating temperatures (working range of 400°-900° C.). This condition has been observed in practice in nickel base electrodes. It can result in early failure of electrodes. Alloying elements such as Cr, Mn, Si, etc., tend to modify the liquid phase formation in the Ni—S system, but the problem still generally persists.

According to one aspect of my invention, iron base alloys are preferable for imparting resistance to formation of sulfur, lead and phosphorous liquid phases under spark plug operating conditions.

The proposed alloy for this application will have excellent cyclic oxidation resistance up to a temperature of 1150° C. Such resistance covers lead, phosphorous, sulfur, and chloride deposits which are the most common contaminants in automotive application. The alloy of my invention forms very adherent and pore free $\alpha$—$Al_2O_3$ protective oxide scales. It also is ferritic at all operating temperatures since the ferritic material is generally the same structure as the spark plug shell, it has matched thermal, weldability and other characteristics when compared to the main metal body 18.

In the past, Such Fe—Cr—Al—RE alloys have not been proposed for use in electrode applications because of the nature of the protective $\alpha$—$Al_2O_3$ oxide. In general, both $\alpha$—$Al_2O_3$ and $Cr_2O_3$ (formed on high temperature alloys as protective oxides) are electrically insulating. As a result, sparking or electrical discharge operation as found in typical spark plug application either requires impractical high voltage or simply does not take place.

The situation in my extended life spark plug invention is very different. The electrical discharge surface is provided by the precious metal inserts 26, 30 ("button"), which do not have an insulating oxide layer. Therefore, the use of Fe—Cr—Al—RE alloys not only becomes feasible in extended life plugs, but also offers additional advantages.

Second Embodiment

This embodiment provides a base electrode material of chromium alloy based on previously used nickel based material. While such material is less resistant to sulfur and lead attack, the chromium (depending upon the alloying amount) can modify the sulfur rich liquid formation to a temperature level which is acceptable for some operations. In this embodiment, the base alloy material is Ni—20Cr. The inserts 26, 30 are formed of zirconia stabilized platinum or palladium. As can be seen in FIG. 2, the N—20Cr material, while not as good as the preferred iron-based alloy, has a thermal expansion characteristic (curve 34) which follows that of the inserts (curve 38).

Third Embodiment

Another embodiment of the invention is to process electrodes of the type discussed above so as to produce improved base electrode resistance to attack by known engine deposits including sulfur and lead. As described above, the preferred Fe—Cr—Al—RE alloy forms an $\alpha$—$Al_2O_3$ protective coating which I have found to be especially suitable to protect the base metal of the electrode from further oxidation or contaminant attack.

$Al_2O_3$ ceramic material is almost non-reactive at spark plug operating temperatures (400° C.-900° C.). Therefore, a compact, pore free, and adherent $\alpha$—$Al_2O_3$ layer on the base electrode (Fe—Cr—Al—RE) can act as a shield against S, Pb, and P attack. It can also protect the base metal from further oxidation and carburization. Furthermore, the alloy has the ability to heal its oxide layer if physically damaged.

The advantages of this oxide layer are numerous. This third embodiment is directed to the process of forming such layers. The nature of protective oxides formed on high temperature alloys (both $Al_2O_3$ and $Cr_2O_3$) depends upon the physico-chemical history of the alloy surface. Hence it is imperative that a sound oxide layer be developed in a robust manner so as to assure consistent and reliable protective coating properties. My process avoids oxides which may not be continuous, pore free, smooth, and adherent.

Figure 3:
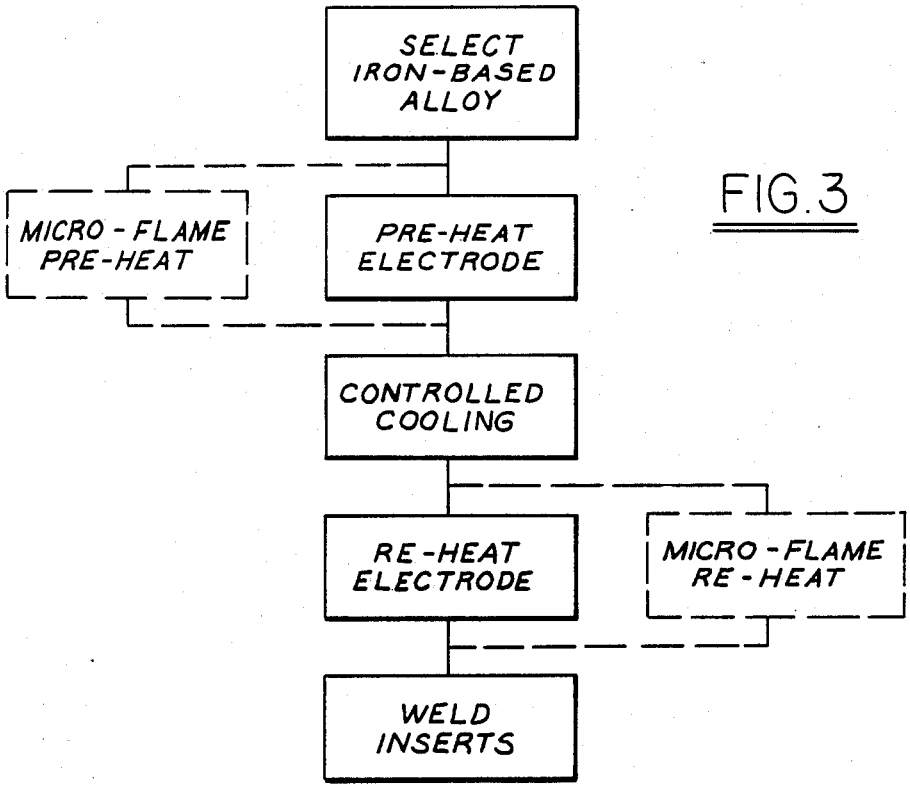
FIG. 3 is a flow sheet of the process of my invention.

As shown in FIG. 3, my process includes a preheat step; an intermediate cooling step, and reheat step. For Fe—Cr—Al—RE alloy, it is proposed that the electrode material be heated in air at about 500°-600° C. for about 30 minutes. This treatment develops or sets up a precursor oxide layer, which when heated to 900°-1000° C. for 30 minutes develops a very sound protective oxide layer. Slow cooling is recommended between the heating steps (for example, 10°-20° C. per minute) to produce an almost stress free oxide precursor layer.

Alternatively, such a resultant oxide layer can be formed by the application of microflame to the desired and selective areas of the surface of the electrodes such that a portion of each will be uncoated. Hence, the oxide layer can be achieved either before or after attaching precious metal inserts. In the alternative case, the inserts will be bonded to the uncoated surface regions. In the fully coated version, it will be necessary to grind oxide from the base metal to define a clean electrical discharge surface onto which the precious metal insert can be bonded.

Similar type resistance can also be imparted to Ni—Cr alloys. In this case, $Cr_2O_3$ is formed as a protective oxide. A good candidate material is Ni—20Cr alloy. The thermal expansion of this alloy is not as well matched to platinum as that of Fe—Cr—Al—RE alloy, but is suitable for certain operating conditions.

Industrial Applicability

Long life spark plugs for internal combustion engines are improved by use of my invention. Longer life glow igniters for aircraft applications can also be made by using the above described inventions. In glow igniters, resistance heating is used to bring the temperature of the igniter coil to a value where combustible mixtures will ignite. Preformed protective oxide layers of the type discussed can extend the life of such glow igniters.

What is claimed is:

1. A process for forming an extended life spark plug having center and side electrodes comprising the steps of:

providing center and side electrodes of base metal alloy including chromium;

heating the center and side electrodes in air at a temperature in the range of 500° C.-600° C. for a time period to form a precursor oxide coating thereon; and reheating the precursor oxide layer at a temperature in the range of 900°-1000° C. to provide a continuous, pore free, smooth adherent protective oxide layer on said center and side electrodes thicker than said precursor coating.

2. In the process of claim 1, selectively heating the surface of the center and side electrodes to retain oxide free regions on each of said center and side electrodes to receive precious metal inserts either before or after development of said oxide coatings.

3. In the process of claim 1, providing a metal alloy of Fe—Cr—Al—RE wherein RE is a rare earth metal constituting 0-1% of the weight of the base alloy to produce a protective coating of $Al_2O_3$ on the base electrode material.

4. In the process of claim 2, providing a metal alloy of Fe—Cr—Al—RE wherein RE is a rare earth metal constituting 0-1% of the weight of the base alloy to produce a protective coating of $Al_2O_3$ on the case electrode material.

5. In the process of claim 2, providing a metal alloy of nickel chromium to produce a protective coating of $Cr_2O_3$ on the base electrode material.

6. In the process of claim 5, selecting the nickel chromium alloy as Ni—20Cr.

7. In the process of claim 1, providing a metal alloy of nickel chromium to produce a protective coating of $Cr_2O_3$ on the base electrode material.

8. In the process of claim 7, selecting the nickel chromium alloy as Ni—20Cr.

* * * * *